United States Patent [19]

Berg et al.

[11] Patent Number: 4,590,721

[45] Date of Patent: May 27, 1986

[54] WOOD PANEL EARTH SHELTER CONSTRUCTION

[76] Inventors: Jeremy R. Berg, 11015 Johnson; John G. Loveless, 1644 Waverly; Walter Senkow, 15044 - 155th, all of Grand Haven, Mich. 49417

[21] Appl. No.: 450,465

[22] Filed: Dec. 16, 1982

[51] Int. Cl.[4] ..... E02D 1/92

[52] U.S. Cl. ..... 52/169.1; 52/745; 52/86

[58] Field of Search ..... 52/518, 595, 807, 86, 52/785, 809, 745, 71, 169.14

[56] References Cited

U.S. PATENT DOCUMENTS

| | | | |
|---|---|---|---|
| 1,108,884 | 9/1914 | Bird | 52/518 |
| 1,639,930 | 8/1927 | Davidson | 52/86 X |
| 2,448,926 | 9/1948 | Stack | 52/86 X |
| 2,766,488 | 10/1956 | Danielson | 52/580 |
| 3,236,020 | 2/1966 | Toffocon | 52/745 |
| 3,407,552 | 10/1968 | Cassidy | 52/169.14 X |
| 3,420,023 | 1/1969 | Gregori | 52/309.9 |
| 3,424,647 | 1/1969 | Callahan et al. | 52/169.14 X |
| 4,147,004 | 4/1979 | Day et al. | 52/309.9 |
| 4,334,393 | 6/1982 | U'Ren | 52/169.6 |
| 4,336,674 | 6/1982 | Weber | 52/11 X |
| 4,388,361 | 6/1983 | Vassalli | 52/595 X |

FOREIGN PATENT DOCUMENTS

| | | | |
|---|---|---|---|
| 880829 | 4/1943 | France | 52/86 |

OTHER PUBLICATIONS

The Condensed Chemical Dictionary, p. 712, 8th ed., Gessner G. Hawley, Van Nostrand Reinhold Co.

Webster's New World Dictionary, p. 748, 2nd College Ed., David b. Guralnik, editor.

Publication entitled "New Organic Visions in Architecture".

*Primary Examiner*—Carl D. Friedman

*Assistant Examiner*—Creighton Smith

*Attorney, Agent, or Firm*—Price, Heneveld, Huizenga & Cooper

[57] ABSTRACT

An arch structure for an earth sheltered building includes a plurality of curved wood panel sections arranged in tandem and in a plurality of adjacent rows. The sections are joined adhesively and define an arch resting on a foundation of footings. Each of the panel sections includes side members joined to end members and ribs extending between the side members and between the end members. Joined to the members are top and bottom skins which enclose the panel and in conjunction with the ribs define a plurality of compartments. Insulation material is disposed within the compartments. At least one of the skins is offset on the side members to define male and female portions which are joined with panel sections in adjacent rows. The panels are fabricated from wood. After assembling into the arch form, the panels are covered with an exterior sheathing which is pressure treated and waterproofed. End walls are attached to the arch section, and the structure is covered with earth.

8 Claims, 15 Drawing Figures

WOOD PANEL EARTH SHELTER CONSTRUCTION

BACKGROUND OF THE INVENTION

The present invention relates to static structures, buildings, dwellings and the like and more particularly to earth sheltered structures.

Due to increased energy costs, desire for conservation and increased interest in designing structures which make more complete use of and merge into the building site, there has been increased awareness of earth sheltered or underground structures. In an earth sheltered building, the soil is used as a barrier against air filtration, and the heat contained in the soil assists in heating and cooling. Earth sheltering reduces energy consumption and moderates temperature changes. Covering or surrounding a structure with earth has other advantages. These include increased protection from vandalism, break-ins and the like, a reduction in noise infiltration or interior noise levels due to exterior sources and increased protection to the occupants from earthquakes, tornados, winds and the elements.

Many problems are, however, associated with earth sheltering designs. These problems include those which are found in conventional dwelling construction and others. Such other problems relate to infiltration, thermal breaks and leaks, freeze/thaw cycles, moisture and water penetration, ventilation, lighting and the like. Also, due to the increased loads on the structures from the soil, additional structural problems must be solved.

Various approaches have been used in the past in constructing earth sheltered dwellings. These approaches include more or less conventional post and beam structures, dome structures and arch structures. A typical post and beam design incorporates buried walls and flat roofs which are covered with soil. Various materials may be used in such structures, including reinforced concrete, masonry and wood. Problems may be presented with each of these building materials. Typically, due to the loading of the flat roof structure, special reinforced beams, joints and/or steel members must be used. Generally, to avoid failure of the roof structure, the spans must be shorter than with conventional housing or greater strength, and more expensive steel beams must be used.

Due to these problems with conventional post and beam approaches, the dome structure and arch structure have been used. Such structures permit an increase in earth loads and therefore increased thermal efficiency when compared to the post and beam structure. A dome structure resolves loading essentially in all directions. A dome, under load, acts similar to a diaphragm. It balances the loads applied to it and obtains high efficiency. Problems are, however, presented with a dome structure in earth sheltered dwellings. The dome is an essentially closed structure. In order to provide ventilation, light, access and the like, the exterior surface of the dome must be penetrated. These penetrations must be reinforced or specially adapted to handle such penetrations. Further, the interior floor plan layout of a dome structure is more complicated when compared to conventional construction. Everytime an exterior wall is joined, a curved surface is presented. In general, contractors find it easier to work with right angles.

Many of the problems associated with post and beam and dome structures are eliminated with an arch structure. An arch supports itself by resolving loads from the roof and walls without creating tension in the structure. The pressure on the outside of the structure helps to maintain its integrity since it is being compressed. An arch is open at both ends. This provides access, egress, ventilation and light. Such openendedness essentially eliminates the need for penetration of the arch structure and the resulting additional expense of compression rings. An arch structure also reduces the complexity of the floor plan layout when compared to dome structures. More right angle work is obtainable.

In constructing an arch based earth sheltered dwelling, various structural considerations must be kept in mind. The loads on an arch essentially create four different kinds of stresses which must be resisted. These are bending stresses, shear stresses, thrust stresses and compressive stresses.

Bending stress tends to cause the top of the arch to move inward and the sides of the arch to move outward. Bending stresses are generally significant only during the construction phase when the earth cover is being placed on the arch. When covered with earth, the arch is stable. The earth at the sides of the structure resists the tendency of the arch to move outward of the sides and prevents the arch from moving downward at the top.

Shear stresses tend to cause the arch to break. Thrust stresses tend to cause the base of the arch to spread. Compressive forces tend to crush the ends of the arch where it joins the footings. Shear stresses are significant after earth load is in place on the top and sides of the arch. Thrust is a lateral tension stress which is located at the base of the arch. This is caused by the arch shape itself. Compressive stresses are maximum under final load conditions. These occur where the arch joins the footings.

One approach to accommodate the structural considerations of an arch involves forming the arch from a plurality of structural steel panels which are preformed and joined on site. The panels are joined in a plurality of rows to obtain the desired circumferential dimension and longitudinal dimension or distance between the front and back of the arch. The steel panels are then sprayed with a concrete mix, such as a Shotcrete or Gunite mix. The concrete mix is sprayed onto the structural steel. The concrete and steel structure resists the shear stresses encountered, and the concrete and steel has high compressive strength. Thrust stresses in such a construction are resisted by elongated steel ties extending through the floor between the ends of the arch where it rests on the footings.

A need exists for an earth sheltered structure which has the benefits of the arch form but which may be more easily and relatively inexpensively erected using more or less conventional construction techniques.

SUMMARY OF THE INVENTION

In accordance with the present invention, a unique wooden arch panel section is provided for use in constructing an earth sheltered building by which the aforementioned problems are solved and the needs are fulfilled. Essentially, a wooden panel section is provided which includes curved, parallel side members joined to end members extending between the side members. Circumferential and transverse rib members extend between the end members and side members, respectively. Top and bottom structural skins are joined to the members to enclose the panel. The panel interior defines a plurality of compartments. The compartments may be filled with insulation. Each of the individual panel sections define joint means along the side members.

The individual panels may be prefabricated at a factory and shipped to the construction site. The panels are assembled by joining them in tandem and in rows with adjacent rows being joined together at the joint means. The reinforced panel structures provide excellent insulation qualities and are sufficiently strong to accommodate and counteract the stresses encountered.

The exterior surface of the arch formed by the individual panel sections is covered with plywood sheathing. The exterior of the sheathing is then waterproofed. The wooden panels are preferably plywood or oriented strand particle board. The sheathing is preferably plywood pressure treated with a preservative. Reinforced plastics may be used alone or in concert with the above materials. End walls are easily bolted to the front and back ends of the arch. The base of the arch may be joined together by steel rods or ties to resist thrust loading.

An earth sheltered structure in accordance with the present invention may be constructed at significantly reduced cost when compared to the prior steel panel and cement forms of fabrication. Since the panels are fabricated from wood materials, more or less conventional carpentry techniques may be used in the construction. Problems heretofore experienced with specialized skills and additional subcontractors are eliminated. The wood construction has the desired thermal characteristics and strength characteristics all at a reduced cost when compared to prior approaches.

DETAILED DESCRIPTION OF THE PREFERRED EMBODIMENT

Figures 1, 2:
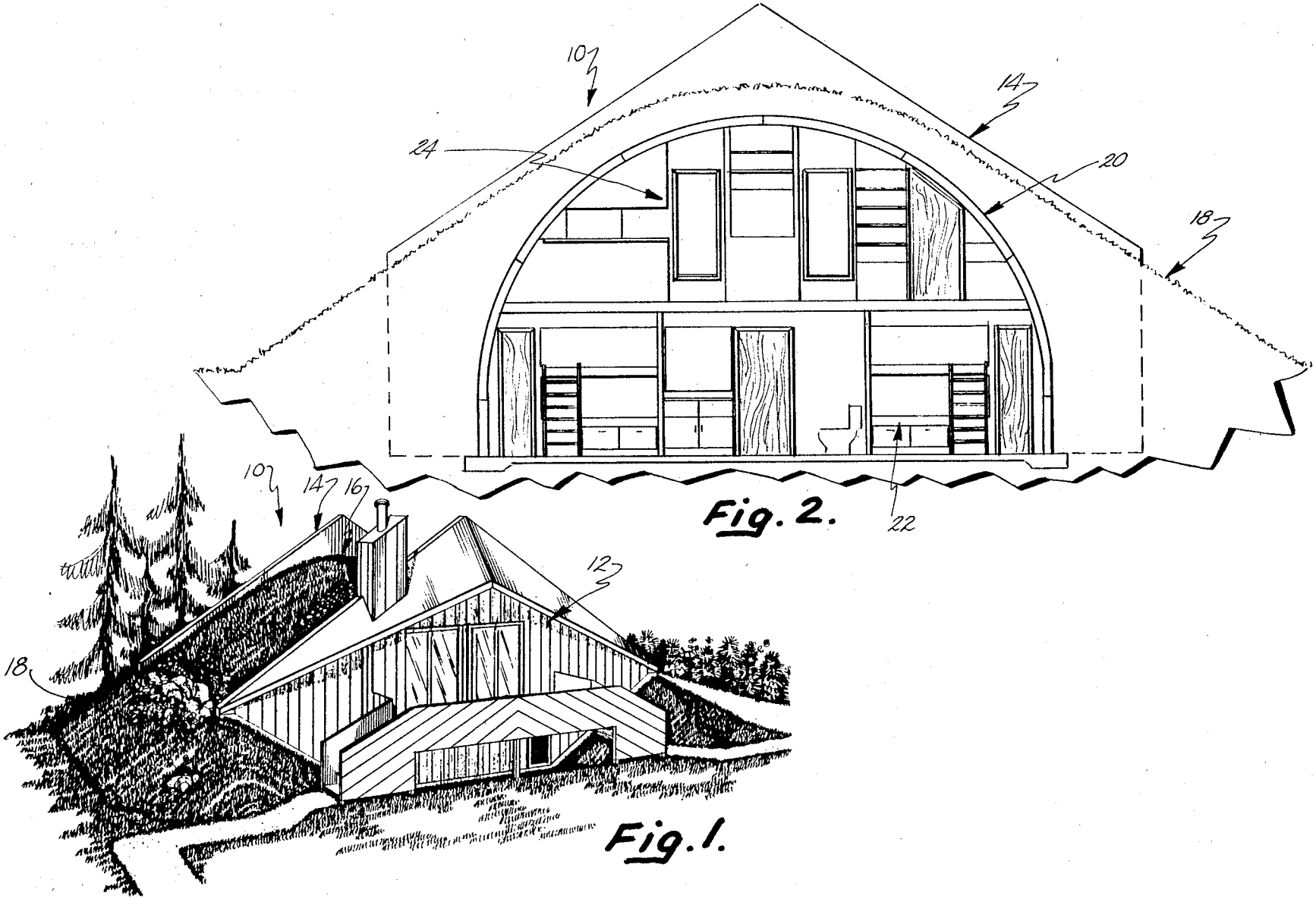
FIG. 1 is a perspective view of an earth sheltered dwelling in accordance with the present invention.
FIG. 2 is a rear, sectional view of the dwelling.

FIGS. 1 and 2 illustrate an earth sheltered dwelling or building in accordance with the present invention and which is generally designated 10. Dwelling 10 is based upon an arch support structure and includes a front wall 12 and a rear wall 14. The sides and roof area 16 of structure 10 are covered with dirt or soil 18.

As seen in FIG. 2, the basic structural portion of dwelling 10 is an arch generally designated 20. End walls 12, 14 extend above the arch and act as retaining walls for the soil 18. The arch-shaped dwelling 10, due to its open front and back ends, provides for ready access and egress from the structure, lighting, ventilation and the like. As illustrated in FIG. 2, the arch structure permits a two-level interior floor plan including a lower level 22 and an upper level 24. The floor plan and interior of the dwelling are conventional in construction. A wide variety of floor plans are possible with the arch shape.

Figure 3:
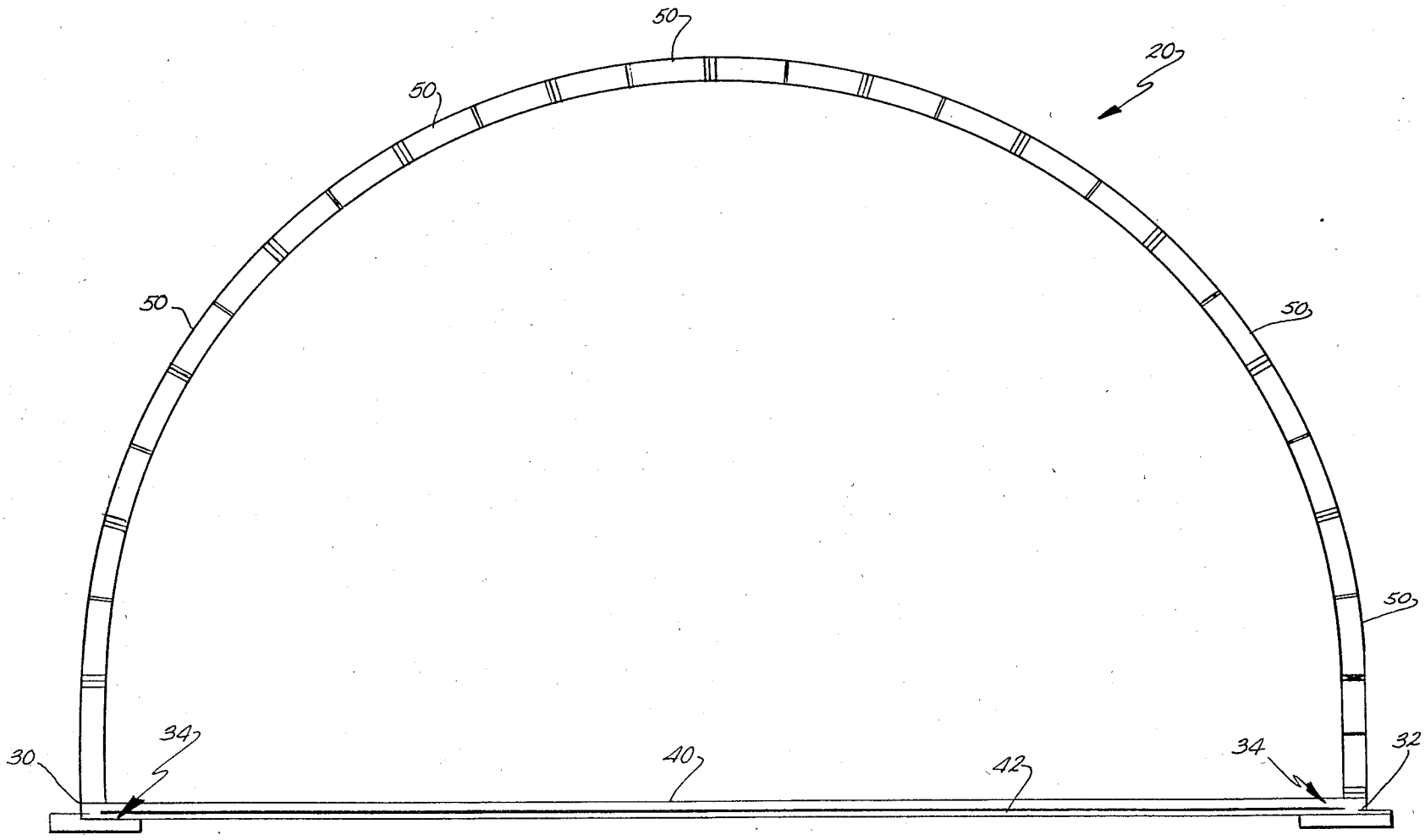
FIG. 3 is a front, sectional view of an arch in accordance with the present invention.
Figure 12:
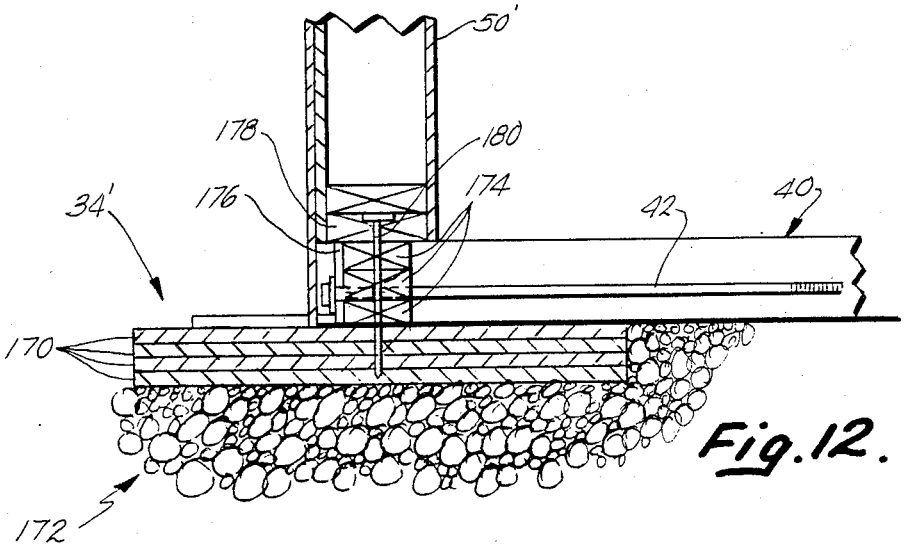
FIG. 12 is a fragmentary, cross-sectional view showing an alternative footing structure for the arch.
Figure 13:
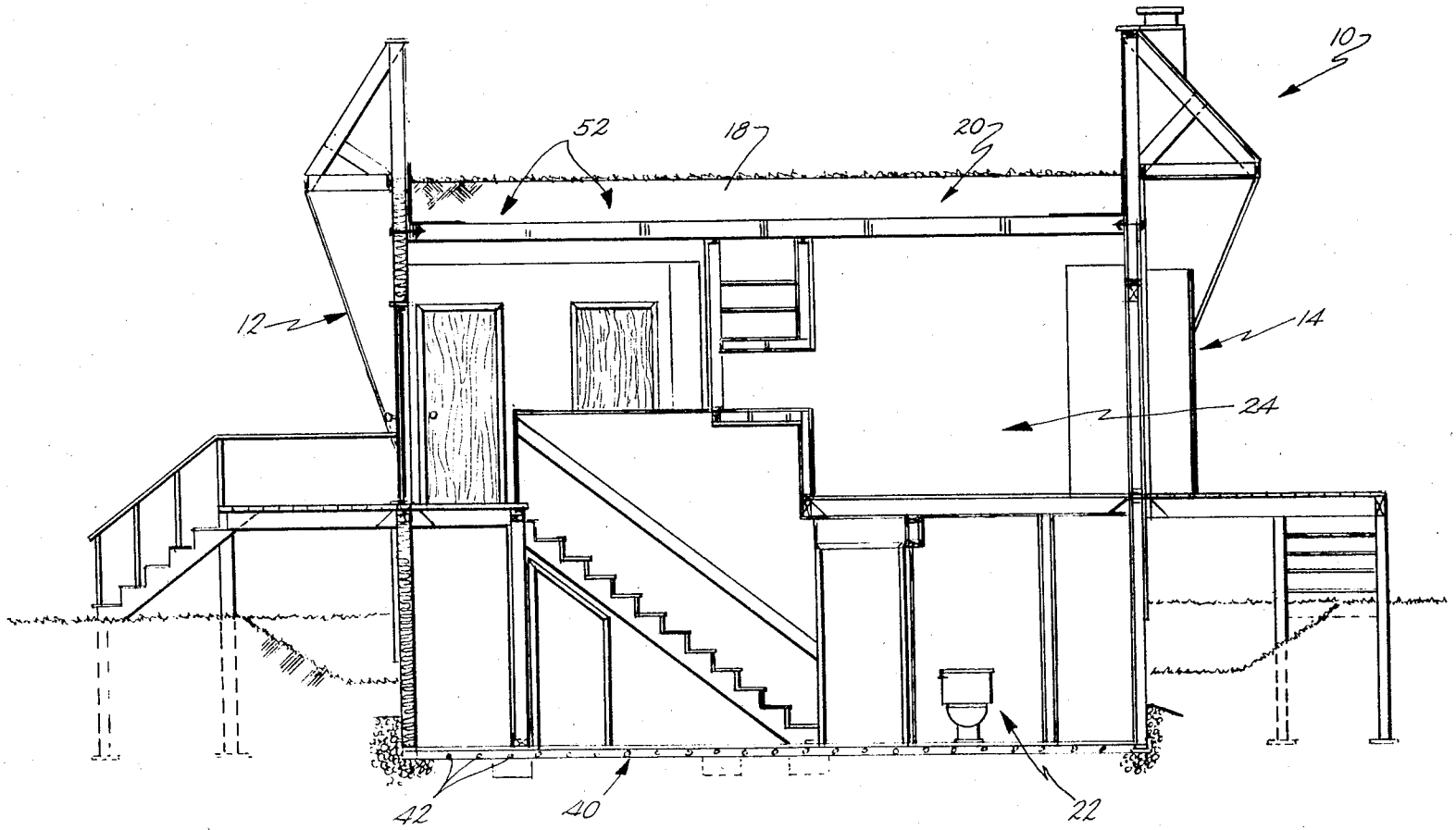
FIG. 13 is a cross-sectional view of an earth sheltered dwelling in accordance with the present invention; showing an interior floor plan.

As seen in FIGS. 3 and 13, arch structure 20 includes a base having ends 30, 32 which rest on footings 34. Footings 34 are described in detail below in connection with FIGS. 11 and 12. In the preferred form, the arch structure 20 is positioned over a poured concrete floor 40. As described in detail below, base ends 30, 32 of arch 20 are tied together by elongated rods 42 which are schematically illustrated in FIGS. 3 and 13. Rods 42 are embedded within the floor 40. Arch 20 is defined by a plurality of individual panel sections 50. Panel sections 50 are joined end to end or in a tandem relationship to define a row. A plurality of such rows designated 52 in FIG. 13 are joined to adjacent rows, as described in more detail below.

Figure 4:
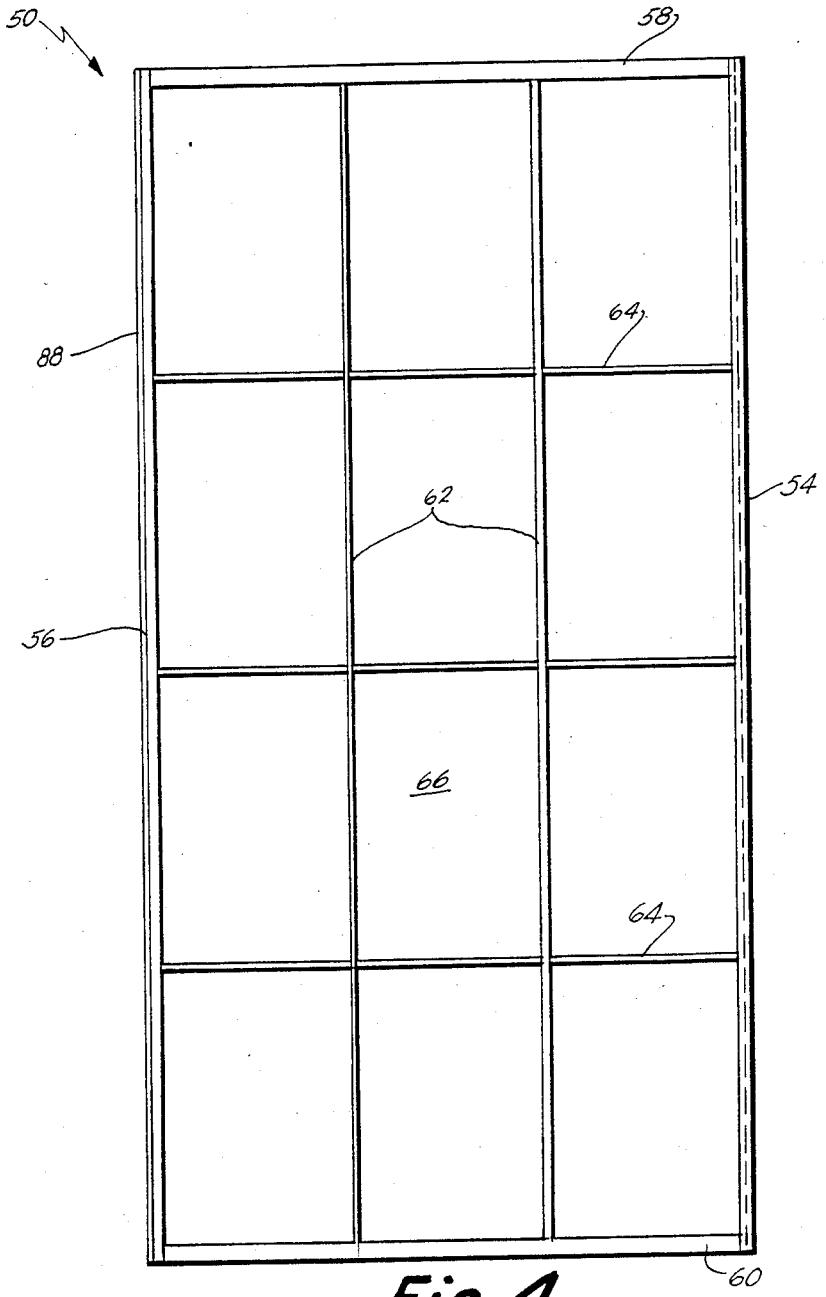
FIG. 4 is a bottom, plan view of a wooden panel section in accordance with the present invention.
Figure 6:
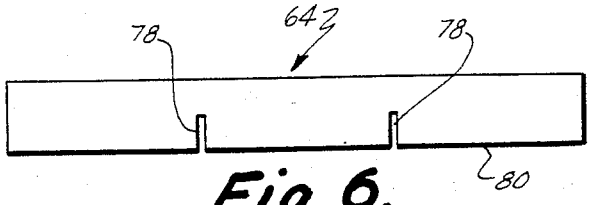
FIG. 6 is a side, elevational view of a transverse rib.
Figure 9:
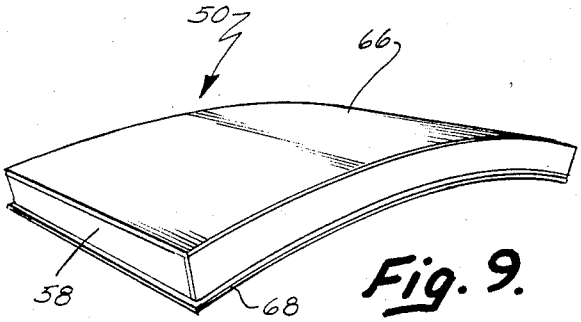
FIG. 9 is a perspective view of a completed panel section.
Figure 5:
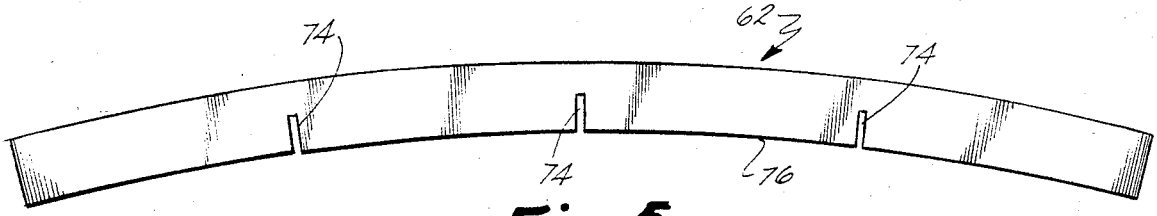
FIG. 5 is a side, elevational view of a circumferential rib incorporated in the panel.

In accordance with the presently preferred embodiment of the invention, individual panel sections 50 are fabricated from wood materials. As seen in FIG. 4, the basic structural configuration of panels 50 includes side members 54, 56. Side members 54, 56 extend in parallel to each other and are joined to structural lumber end materials 58, 60. Extending between end members 58, 60 are circumferential ribs 62. Extending between side members 54, 56 are transverse ribs 64. Ribs 62, 64 provide strength and rigidity to the section. The top and bottom of the panel section is covered with structural skins 66, 68, respectively (FIG. 9).

In an embodiment of the present invention, side members 54, 56 are formed from plywood. The members could also be formed from oriented strand particle board. End members 58, 60 are pieces of structural lumber. The side members are cut to the desired curvature for the final arch shape. Rib members 62, 64 and skins 66, 68 are formed from oriented strand board such as that sold under the trademark Oxboard by Potlach Corp.

Figure 7:
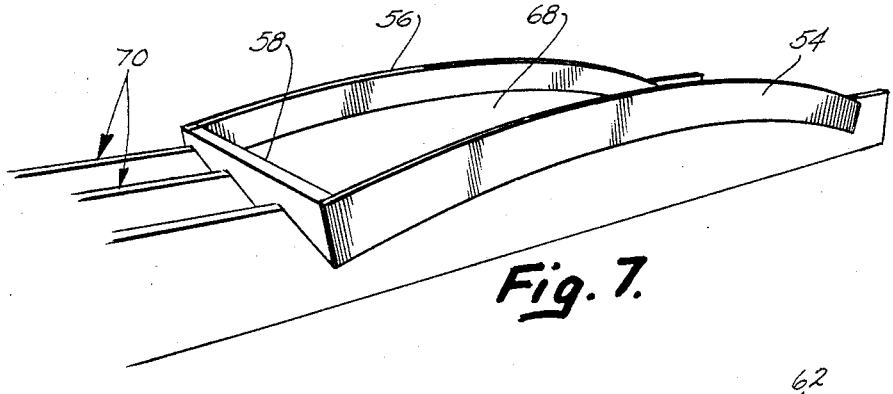
FIG. 7 is a perspective view showing one step in the fabrication of the wood panel section.

As seen in FIG. 7, the panel elements are assembled using forms 70. Each form 70 is cut to define a curved surface of the desired arch and length. Bottom skin 68 is placed in the form. Side members 54, 56 and end members 58, 60 are positioned on the skin. The side members and end members are joined using a suitable adhesive.

Figure 8:
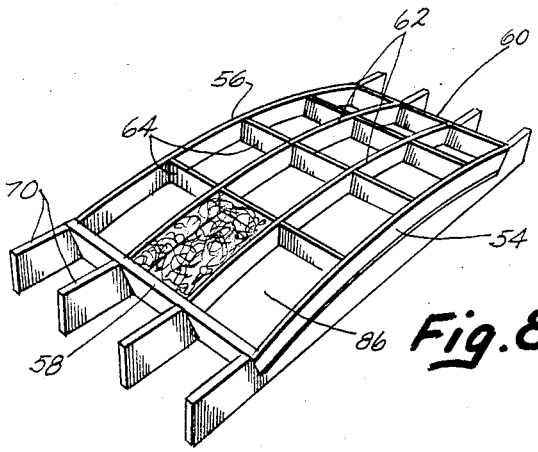
FIG. 8 is a perspective view showing a further step in the fabrication of the wood panel section.

Circumferential ribs 62 have the same curved configuration as side members 56, 54. Ribs 62 define notches 74 at equally spaced points opening through a lateral edge 76 thereof. Transverse ribs 64 have the same longitudinal dimension as end members 58, 60. Transverse ribs 64 include notches 78 opening through a lateral edge 80. Transverse ribs 64 are placed on the bottom skins 68, as shown in FIG. 8, with notches 78 facing upwardly. Ribs 62 are positioned over ribs 64 so that notches 74 slip into notches 78.

After the partially completed panel is set up as illustrated in FIG. 8, compartments 86 defined by the ribs and side members and end members may be filled with a suitable insulation material. It is presently preferred that expanded polystyrene beads be used as the insulation material. These beads are poured into the compartments until such are filled. Next, top skin 66 is placed over and against the ribs, side members and end members. Inverted forms 70 (not shown) are placed over the top panel, and the whole assembly is clamped until the adhesive sets.

As seen in FIGS. 4 and 9, skins 66, 68 are offset towards side member 56 of the panel. Panel 66, for example, as seen in FIG. 4, overhangs side member 56 along a portion 88. The overhang of skings 66, 68 define a female side or joint portion along one side of the panel. The opposite side of the panel along side member 54 defines a male side or joint portion. As explained below, adjacent panels are glued and interconnected along the joint defined by the female and male sides.

Figure 11:
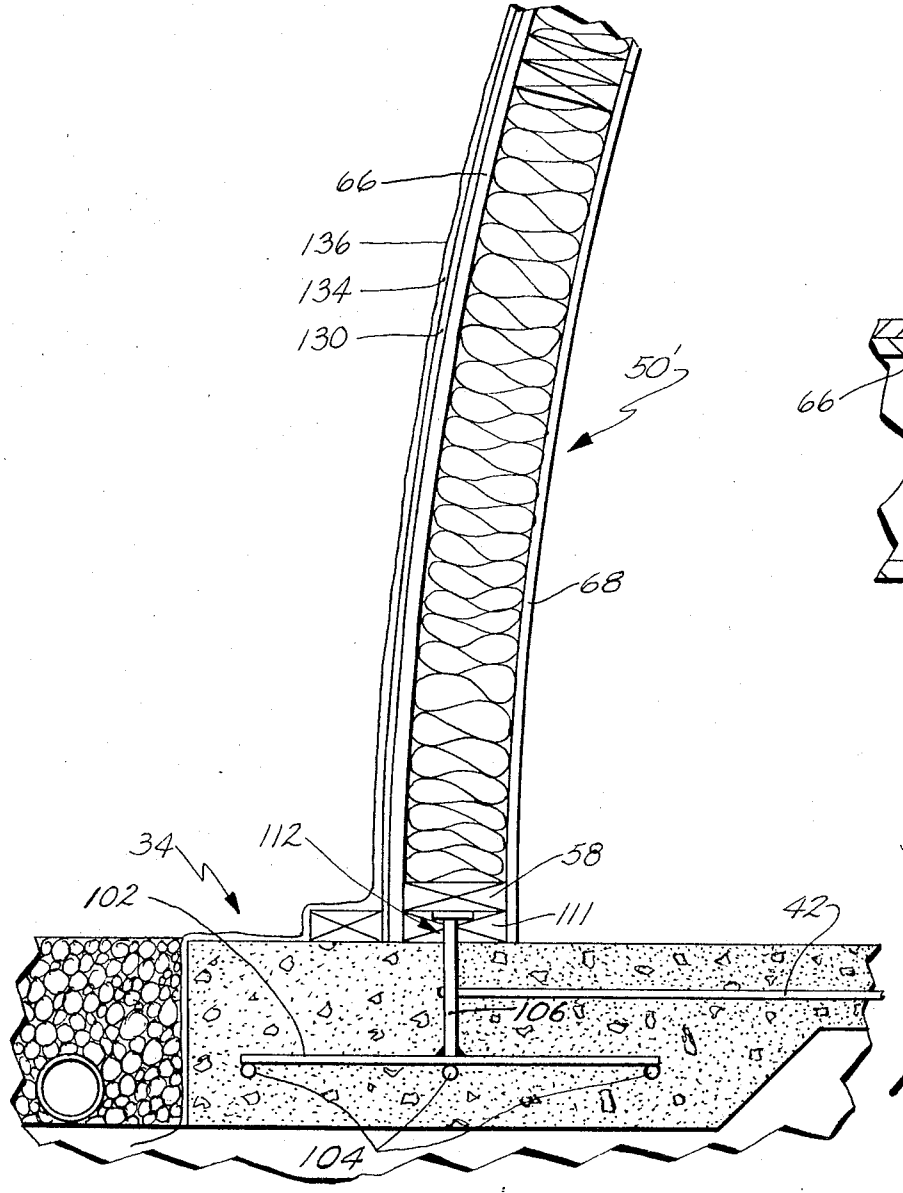
FIG. 11 is a fragmentary, cross-sectional view showing the base of the arch and the footing structure.

Panels 50 are easily assembled at a central manufacturing facility. The panels may be standardized in size and curvature to the particular arch shape desired. After fabrication, the panels are delivered to the construction site. As an initial step in the construction, the floor is poured. As seen in FIG. 11, it is presently preferred that concrete footings 34 be used. The footing structure includes reinforcing bars 102, 104. Bars 102 are joined to anchor bolts 106. Anchor bolts at each footing 34 are tied together by steel tie rods 42. The ends of the tie rods 42 may be wrapped around the anchor bolts. It is presently preferred that members 102 be No. 4 rebar positioned at 12 inch centers and that members 104 are No. 5 rebar positioned at 10¾ inch centers to define a reinforcing mat. Tie bolts 106 are welded to the reinforcing mat and positioned at 12 inch centers. Tie bolts 106 extend through an anchor board 111 on floor 40. The footing, reinforcing mat, anchor bolts and rod 42 tie the lower ends or base of the arch structure together to resist thrust loading or stresses.

A panel section 50' (FIG. 11) which rests on footing 34 has top and bottom skins 66, 68 which extend beyond a lower end member 58 to define groove 112. Groove 112 receives anchor board 111. End members 56 of each panel section 50' on footing 34 are glued, nailed and bolted to anchor board 111.

Arch 20 is erected at the construction site by joining each of the individual panel sections at their ends and along their sides to adjacent rows or adjacent panel sections within each row. It is presently preferred that an array panel layout be used wherein joints between adjacent panels in a row are staggered. The end rows adjacent the end walls 12, 14 of the arch are, for example, defined by 8 foot length panel sections. The next adjacent interior row of the arch section would include a 4 foot base panel section 50' at each footing with the remaining panel sections in the row being 8 foot lengths. The next row would then be formed with 8 foot panel sections. In this manner, a staggered end joint arrangement is obtained.

Figure 10:
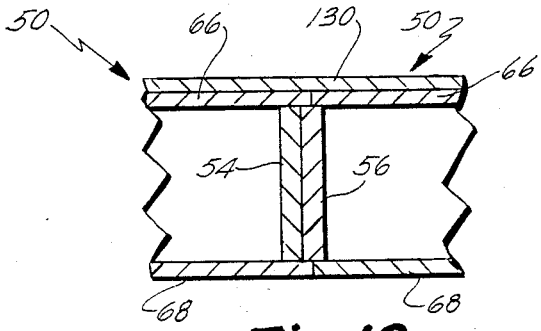
FIG. 10 is a fragmentary, cross-sectional view in elevation showing the joint between a pair of panels in adjacent rows.

The side joints between panels in adjacent rows is illustrated in FIG. 10. As shown therein, a panel section 50 having side member 54 and overhanging top and bottom skins 66, 68 defines a female side which receives a corresponding male side of an adjacent panel 50. The joint shown is a tongue and groove arrangement. In the alternative, only bottom skin 68 need be offset. The joint would then be a lap joint. Adhesive is applied to the joint, and the panel sections are bonded together. In the alternative, the sections could be joined by fasteners such as bolts, screws and/or nails with or without adhesives.

After the panels have been bonded together to define the arch 20, the exterior surface of the arch is covered with plywood sheathing. Such sheathing is designated 130 in FIGS. 10 and 11. In a preferred form, the sheathing is ½ inch pressure treated plywood sheets which are glued and nailed to the panel sections. The plywood sheets are positioned so that the joints between adjacent plywood sheets are lapped over the panel section joints a distance of at least 12 inches. The arch is waterproofed after being covered with the sheathing. As illustrated in FIG. 11, bentonite 134 is sprayed or troweled onto the outer surface of the sheathing. A polyethylene film 136 is then applied to the surface.

If it is desired to increase overhead lighting, certain of the panels could serve as skylights. Skins 66, 68 would be formed from a translucent or transparent material such as a polyacrylate or equivalent polymer. In such case, the skylight panel would not include insulation which would block light passage. Also, the rib structure could be modified for aesthetic reasons. Further, the skin areas over only one or more of compartments 86 could be translucent or transparent. The sheathing overlying such skylight panels would, of course, also need to be left open or substituted with a transparent or translucent layer.

Figure 14:
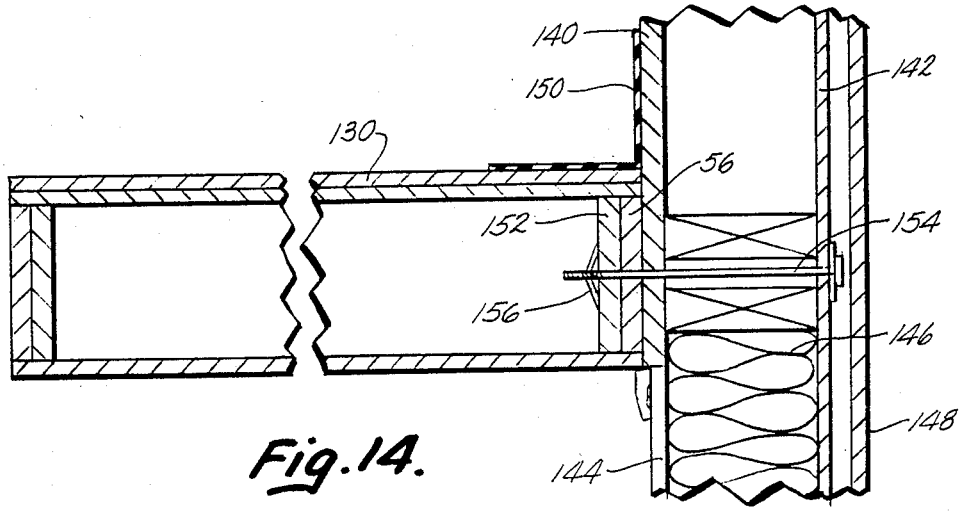
FIG. 14 is a fragmentary view showing a manner by which an end wall is joined to the arch.
Figure 15:
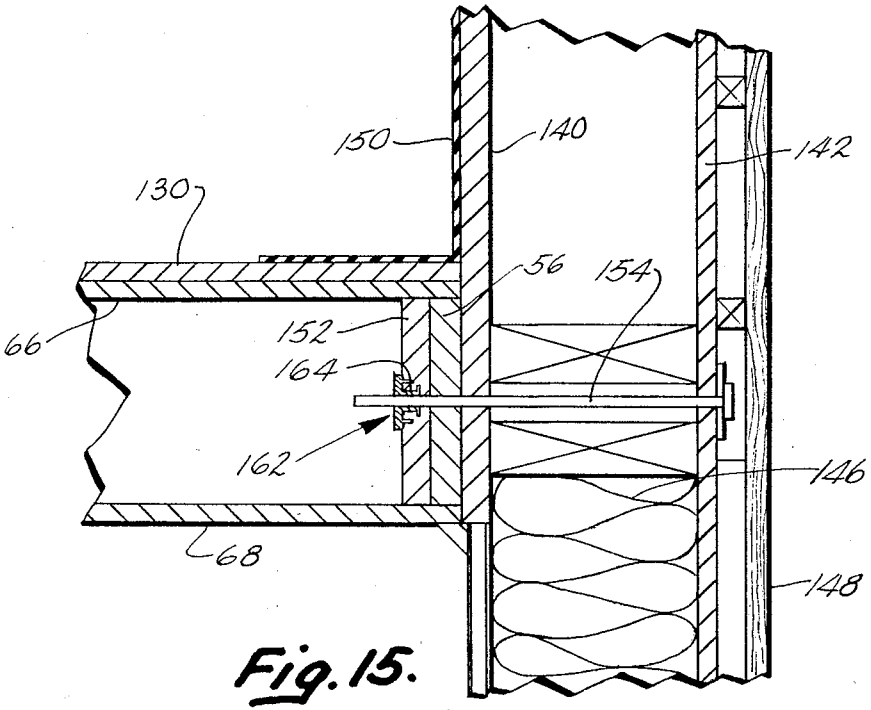
FIG. 15 is a fragmentary, cross-sectional view showing an alternative method of joining the end wall to the arch.

An end wall detail is illustrated in FIG. 14. As shown therein, a typical end wall would include a ½ inch plywood extension or retainer 140, exterior ½ inch plywood 142 and an interior ½ inch drywall sheet 144. The space between drywall 144 and plywood sheets 142 is filled with a suitable insulation 146. Siding 148 is applied to the exterior surface. Rubber flashing 150 is applied at the angle between the sheathing 130 and plywood retainer 140. The panel sections at which the end wall is joined to the arch preferably include additional side members 152 glued to side members 54, 56. Side members 56, 152 are drilled to receive a bolt 154. In the embodiment illustrated in FIG. 14, the bolt extends through the end wall and is secured to a toggle 156. An alternative method of joining the side walls to the arch structure is illustrated in FIG. 15. As shown therein, side members 56, 152 are drilled, and a threaded nut 162 is press fitted into a counter bore 164 and reinforcing member 152. The panel sections along the end rows are preformed with the bolt holes and nuts.

An alternative footing structure is illustrated in FIG. 12. As shown therein, a wood footing may be used. Floor 40 is a poured concrete slab. Footing 34 is defined by four ¾ inch pressure treated plywood plates 170. The plywood plates are positioned on a 3 inch minimum gravel draining 172. The plates are alternated in cross grain orientation, are glued and nailed together. The base of the arch or ends are tied together by tie rods 42. In this embodiment, however, tie rods 42 extend between three 2×4 boards 174 which are pressure treated and glued together on the footing. The ends of the tie rods 42 abut against a pressure plate 176. A 2×6 board 178 is glued and nailed to boards 174. Lag bolts 180 extend through board 178 and boards 174 and into the wood footing 170. Panel section 50' is then glued and nailed to a 2×6 178.

The earth sheltered structure in accordance with the present invention provides all of the advantages obtained from an arch shape and which makes such form particularly desirable. The resulting structure provides an open, airy space which is well lighted and easily ventilated. The wood nature of the construction permits carpenters to erect the building and eliminates cost and expertise problems heretofore associated with steel, concrete and other such construction methods. The panel sections may be prefabricated at a central location and shipped to the site for assembly. The panel sections are joined using conventional gluing or adhesive techniques.

It is presently preferred that the 2×6 lumber and other boards be Douglas fir or Southern Pine graded No. 2 or better. The top and bottom skins and the rib members of the panels are preferably formed from ½ inch oriented strand board which is APA rated exposure 1 sheathing. The ¾ inch plywood is preferably structural C-D exposure rated 1 which is produced to U.S. Product Standard P.S. 1-74 and ANSI 199.1. The plywood skin sheathing is preferably ½ inch exposure rated and manufactured according to U.S. Products Standard P.S. 1-74 ANSI A199.

The wood is preservative treated. A pressure treatment with chromated copper arsenate preservative salt is preferred. Salt retention is preferably 0.60 pounds per cubic foot. After treatment, the lumber and sheathing are preferably dried to a moisture content less than 18 percent. Any lumber or sheathing which is cut or drilled after treatment should be field coated with a 3 percent chromated copper arsenate solution prior to assembly.

The exterior waterproofing of the arch is preferably done with Bentonize R-80-S waterproofing sold by Effective Building Products, Minneapolis, Minnesota, which is applied to a thickness of 3/16 inch. The rubber flashings are preferably two-part cold applied liquid rubber in a nylon fabric or fully adhered E.P.D.M. rubber.

It is presently preferred that the adhesive used be emulsion polymer isocyanates which meet ASTM 2559-76, D-3434-75, D-3535 and WHI 1980-08-08 standards and commercial standards P.S. 1-74 exterior P.S. 51-71-Type 1, P.S. 56-73-structural and CA 25-4-structural.

During construction, the arch should be adequately shored. The shoring should be left in place during backfilling. Also, shoring is necessary for the front and back end walls during backfill and until the interior floor system is in place. Backfilling or covering of the structure with dirt should be done in such a way as to insure balanced earth loads at all times. It is preferred that deflection be limited to ¾ inch during backfill. This should be monitored to prevent damage to the structure. If deflection at the top of the arch during backfilling approaches ¾ inch, soil can be placed on top to balance the pressure. If a wooden foundation is used, the foundation is an all-weather wood foundation, and the National Forest Products Association's Technical Report No. 7 may be referred to for installation instructions.

In view of the foregoing description, those of ordinary skill in the art may envision various modifications which would not depart from the inventive concepts disclosed herein. Therefore, it is expressly intended that the above description should be considered as that of the preferred embodiments. The true spirit and scope of the present invention may be determined by reference to the appended claims.

The embodiments of the invention in which an exclusive property or privilege is claimed are defined as follows:

1. An earth sheltered building including an arch structure, said structure including footings, a floor extending between said footings and arch means extending between said footings and having a base having lower ends on said footings for defining an enclosure which is covered with earth and open at opposite ends, wherein said arch structure comprises:

a plurality of joined, curved wooden panel sections arranged in tandem in a plurality of adjacent rows with more than two panel sections in a row, each of said sections including circumferentially extending wooden side members, transversely extending structural wooden end members joined to said side members, ribs extending between said side members and said end members to divide said sections into a plurality of compartments, a bottom structural wooden skin joined to said members, a top structural wooden skin joined to said members to enclose the compartments and insulation disposed within said compartments, said top and bottom skins being oriented strand board, said sections further including joint means along the side members of adjacent panels sections for joining said rows to each other, said joint means comprising at least one of said top and bottom skins of said panel sections being offset towards one of said side members to define a female side and a male side, said female side receiving a male side of an adjacent panel section in an adjacent row;

wooden sheathing sections overlying said top skins of said panel sections, said sheathing including a plurality of plywood sheets lapped over the joints between said panel sections and treated with a preservative;

an adhesive joining said panel sections together within each row and to adjacent rows;

waterproofing means on said sheathing for waterproofing the exterior surface of said arch means;

connecting means engaging the base of the arch means at said footings and within said floor for tying said base together at its lower ends; and end walls and fastener means for joining the end walls to lateral edges of said arch means, said end walls dimensioned to extend above said arch means to retain earth placed on said arch means.

2. An earth sheltered building as defined by claim 1 wherein said side members are plywood.

3. An earth sheltered building as defined by claim 2 wherein said ribs are oriented strand board.

4. An earth sheltered building as defined by claim 1 wherein said adhesive is an emulsion polymer isocyanate.

5. A method of constructing an earth sheltered structure, comprising the steps of:

joining a plurality of wood panel sections by applying an adhesive to said sections to bond them together in adjacent rows with more than two panels in each row to define an arch having a base with ends, each of said panel sections including curved wood side members joined to wood end members, ribs extending between said members, a top structural wooden skin joined to said members, a bottom structural wooden skin joined to said members and insulation within said panel sections, said top and bottom skins being oriented strand board;

covering the top skins of said panel sections with pressure treated wooden sheathing by gluing and nailing a plurality of sheets to said sections and lapping the joints of said sheets over the joints of said panel sections;

waterproofing the exterior surface of said sheathing;

joining said base ends with elongated rods to prevent said ends from shifting away from each other;

joining end walls to said arch; and covering said arch with earth.

6. A method as defined by claim 5 wherein said step of joining said end walls includes the step of passing an elongated bolt through said end walls and into said panel sections adjacent said end walls.

7. A method as defined by claim 6 wherein said waterproofing step includes the steps of applying a layer of bentonite to said sheathing; and covering said bentonite with polyethylene film.

8. A method as defined by claim 7 further including the steps of treating said sheathing and said panel sections with a wood preservative.

* * * * *